US005456233A

United States Patent [19]

Felhofer

[11] Patent Number: 5,456,233

[45] Date of Patent: Oct. 10, 1995

[54] FUEL INJECTION ARRANGEMENT FOR INTERNAL COMBUSTION ENGINES

[75] Inventor: Hubert Felhofer, Aigen, Austria

[73] Assignee: Robert Bosch GmbH, Stuttgart, Germany

[21] Appl. No.: 233,175

[22] Filed: Apr. 26, 1994

[30] Foreign Application Priority Data

Apr. 28, 1993 [DE] Germany ..... 43 13 852.7

[51] Int. Cl.[6] ..... F02M 37/04

[52] U.S. Cl. ..... 123/447; 123/456

[58] Field of Search ..... 123/447, 456, 123/446, 467, 458

[56] References Cited

U.S. PATENT DOCUMENTS

| | | | |
|---|---|---|---|
| 2,986,881 | 6/1961 | Moore | 123/447 |
| 3,507,263 | 4/1970 | Long | 123/456 |
| 4,280,464 | 7/1981 | Kanai | 123/447 |
| 4,627,403 | 12/1986 | Matsumura | 123/447 |
| 4,712,528 | 12/1987 | Schaffitz | 123/447 |
| 4,719,889 | 1/1988 | Amann | 123/467 |
| 5,012,786 | 5/1991 | Voss | 123/447 |

FOREIGN PATENT DOCUMENTS

| | | | |
|---|---|---|---|
| 0307947 | 3/1989 | European Pat. Off. . | |
| 0056935 | 5/1981 | Japan | 123/447 |
| 3054357 | 3/1991 | Japan | 123/447 |
| 5026058 | 2/1993 | Japan | 123/447 |

*Primary Examiner*—Carl S. Miller

*Attorney, Agent, or Firm*—Edwin E. Greigg; Ronald E. Greigg

[57] ABSTRACT

A fuel injection arrangement for internal combustion engines, having a high-pressure fuel pump driven by the engine. The high-pressure fuel pump fills a pressure reservoir chamber with fuel at high pressure which chamber in turn communicates via injection lines with injection valves that protrude into the combustion chamber of the engine to be supplied. For free choice of the injection pressure at the injection valves independently of the rpm, the proposed system operates with two pressure levels. The higher pressure level is the maximum pressure in the pressure reservoir chamber, which via a connecting line that can be opened by means of a connecting valve communicates with a pressure chamber that builds up a second pressure level, and from that chamber the injection lines lead away in turn. The pressure chamber can also be rapidly pressure-relieved via a relief line that has a magnet valve. By way of opening the valve, the pressure in the pressure chamber and in the injection lines can now be varied or modulated during the injection event; a constant injection pressure is attainable via a reservoir device that communicates with the pressure chamber.

12 Claims, 1 Drawing Sheet

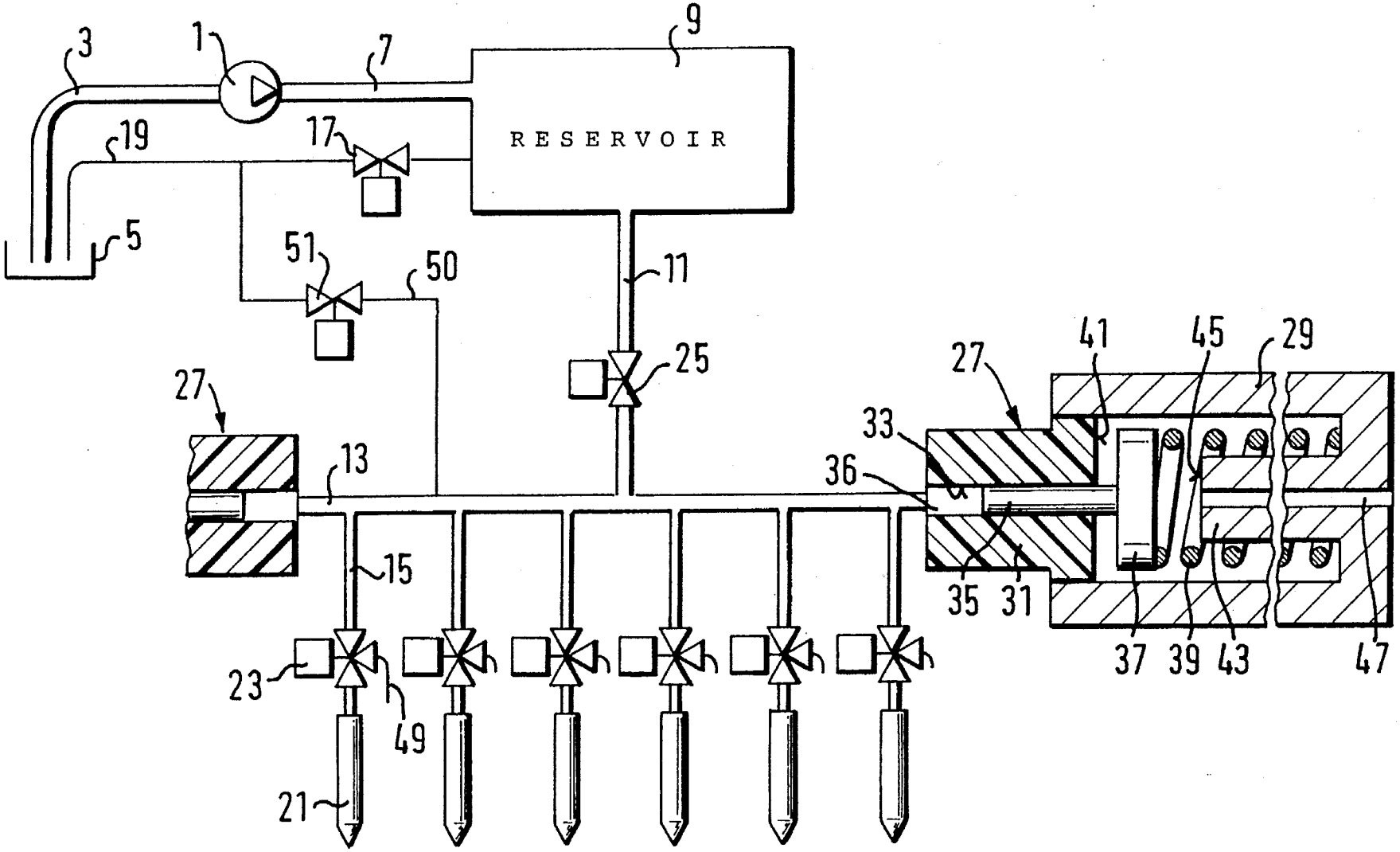
RESERVOIR
9
11
25
7
17
50
51
1
3
19
5
13
27
15
49
23
21
33
36
35
31
37
39
43
45
41
29
47

FUEL INJECTION ARRANGEMENT FOR INTERNAL COMBUSTION ENGINES

BACKGROUND OF THE INVENTION

The invention is based on a fuel injection arrangement for internal combustion engines as defined hereinafter. In one such fuel injection arrangement, known from EP 0 307 947, which serves to supply fuel to an internal combustion engine, a high-pressure fuel pump fills a pressure reservoir chamber with fuel at high pressure, via a high-pressure line. From this pressure reservoir chamber, fuel injection lines lead to the individual injection valves protruding into the combustion chamber of the engine to be supplied; the pressure reservoir chamber is kept at a predetermined pressure by a pressure control device, so that independently of rpm, the injection pressure can be defined at the injection valves over the entire operating performance graph of the engine to be supplied.

To control the injection times and quantities of the injection valve, an electrically controlled valve is inserted into each injection line; with its opening and closing it controls the high-pressure delivery of fuel to the injection valve.

The known fuel injection arrangement has the disadvantage that the injection pressure at the injection valves is not freely selectable arbitrarily, but instead is dependent on the pressure in the pressure reservoir chamber. Nevertheless, achieving the most favorable possible fuel preparation for optimal, low-polluting combustion in the engine combustion chamber at every operating point requires being able to set not only the instant and duration of injection but also the injection pressure variably as a function of engine operating parameters.

These demands for a freely selectable injection pressure at the injection valve, which moreover must be adjustable within very short periods of time, are not met by the known fuel injection arrangement, since an adjustable pressure variation must be effected via the pressure reservoir system, which for functional reasons involves great inertia and because of this rigidity does not allow quick changes of pressure.

OBJECT AND SUMMARY OF THE INVENTION

The fuel injection arrangement according to the invention has the advantage over the prior art that by the additional disposition of a pressure chamber between the pressure reservoir chamber and the injection lines, the added pressure chamber being openable toward the pressure reservoir chamber, the injection pressure at the injection valve is freely selectable over the entire performance graph. The pressure in the pressure chamber, which via the injection lines discharging into it is equivalent to the injection pressure, can be arbitrarily adjusted by controlling the duration of opening of the valve in the connection to the pressure reservoir chamber, as a function of the injection quantity. By a suitable control of this connecting valve, the injection pressure can advantageously also be increased during injection, so that the course of injection can thus be shaped.

In order to avert a pressure drop from the injected fuel quantity in the pressure chamber (common rail), which is separate from the pressure reservoir chamber during the high-pressure injection and communicates constantly with all the injection lines, the pressure chamber may be made to communicate with a reservoir device, which advantageously is formed by a reservoir piston that is prestressed by fuel counter to a restoring force during the pressure chamber filling phase, and that during the injection phase reduces the fuel-filled volume by the amount of the injection quantity, so that the pressure in the pressure chamber can be kept virtually constant, with the injection work being performed by the reservoir piston. If the fuel injection arrangement is intended to operate at maximum injection pressure, the connecting valve remains open, and the reservoir piston continues to be in contact with a stop that limits its maximum storage stroke.

Furthermore, the design of the pressure chamber, with a very much smaller volume than the pressure reservoir chamber, makes short pressure changing times possible, via the filling which is controlled by the connecting valve. Advantageously, the pressure chamber is dimensioned such that not only can the pressure level in the pressure chamber be kept constant during injection of an injection valve, with reinforcement by the reservoir device, but a rapid decrease in pressure in the pressure chamber is also possible, via the injection event.

This rapid pressure decrease can be reinforced by the advantageous disposition of an additional relief line from the pressure chamber to a low-pressure chamber; this relief line can be opened by means of a magnet valve disposed in the line.

Another advantage of the fuel injection arrangement according to the invention is that it can be combined with components of known fuel injection arrangements, so that structural changes need not be made in the engines to be supplied.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing schematically shows the layout of the injection system, showing the disposition and linkage of the various components; the reservoir device is shown in simplified section.

DESCRIPTION THE PREFERRED EMBODIMENT

In the fuel injection arrangement shown in the drawing, a high-pressure fuel pump 1 communicates with a fuel-filled low-pressure chamber 5 via a fuel supply line 3 and with a pressure reservoir chamber 9 via a high-pressure fuel line 7. The high-pressure fuel pump 1 may for instance be embodied as a single-cylinder plug-in pump or as an in-line pump and is driven synchronously with the associated engine via an engine camshaft. The pressure reservoir chamber 9 has a relief line 19, which contains a controllable pressure valve 17 and discharges into the low-pressure chamber 5, and the pressure reservoir chamber 9 also communicates via a connecting line 11 with a pressure chamber or pressure line 13; injection lines 15 lead away from the pressure line 13, communicating on the other end each with an injection valve 21 (injector) protrudes into the combustion chamber of the engine to be supplied, and to control the injection event, each injection line includes a magnet valve 23. An electrically triggerable connecting valve 25, preferably a magnet valve, is disposed in the connecting line 11, and by way of the magnet line, the connecting line 11 can be opened between the pressure chamber 13 and the pressure reservoir chamber 9.

The pressure chamber 13, which in the exemplary embodiment is tubular, communicates at each of its face ends with one reservoir device 27, which in the exemplary embodiment is formed by a cup-shaped sleeve 29, into the open end of which a cylinder liner 31 is press-fitted in, the cylinder liner having a cylinder bore 33 into which the pressure chamber 13 discharges. A reservoir piston 35 is axially guided in the cylinder bore 33, and with one face end, toward the pressure chamber 13, it defines a work chamber 36 in the cylinder liner 31, while its end protruding from the cylinder bore 33 has a ram 37 that protrudes into the sleeve 29. A restoring spring 29 comes to rest on the face end of the ram 37 of the reservoir piston 35 remote from the cylinder liner 31, and on its other end this spring is supported on the bottom of the sleeve 29 and, in the pressureless state, keeps the reservoir piston 35 in contact, by its ram 37, with a first stop 41 formed by the end of the cylinder liner 31 toward the sleeve. This restoring spring 39 is designed such that it can already be prestressed by a slight pressure rise in the pressure chamber 13 and is overpressured by the maximum injection pressure. The cup-shaped sleeve 29 moreover has a tang 43 in its interior, beginning at the bottom; the face end of the tang forms a second stop 45, which limits the stroke motion of the reservoir piston 35 in the direction of an enlargement of the work chamber 36 and thus by its position determines the maximum reservoir volume. Since for applications in various injection systems this maximum reservoir volume has major significance, the tang 43 may also be replaced by a bolt screwed from outside into the bottom of the sleeve 29, so that the location of the second stop 45 is adjustable via the depth to which it is screwed in. To drain away leaking fuel entering the sleeve 29 via the reservoir piston 35, an oil leakage bore 47 is made in the tang 43; it communicates with a return line, not shown, into the low-pressure chamber 5. Also discharging into the low-pressure chamber 5 are return lines 49, each leading away from the magnet valves 23; from the magnet valves 23, these lines may communicate with the injection valves 21, so that at the end of injection a rapid pressure relief of the injection valves 21 into the return lines 49 is assured. For the sake of a rapid pressure drop in the pressure chamber 13, the pressure chamber communicates with the low-pressure chamber 5 via an additional line 50, and in the exemplary embodiment this connecting line 50 discharges into the relief line 19. A valve 51, preferably embodied as a 2/2-way magnet valve, is disposed in the connecting line 50, and the instant and duration of the rapid pressure relief of the pressure chamber 13 can be controlled via the opening of this valve. This rapid pressure relief of the pressure chamber 13 is brought about first if the pressure in the pressure chamber 13 is to be decreased very rapidly, because a rapid change of load from full-load to idling of the engine to be supplied is to take place; in that case, the valve 25 remains closed.

Secondly, a rapid pressure decrease in the pressure chamber 13 may become necessary between two injection events, in order that the pressure level will be low at the onset of injection. Toward the end of injection, by means of a brief opening of the connecting valve 25, the injection pressure and thus the injection rate can then be increased. To enable this modulation of injection pressure, enough fuel must flow out of the pressure chamber 13 into the low-pressure chamber 5 via the line 50 between injections so that the desired injection pressure will be established at the onset of the injection event in the pressure chamber 13.

The magnet valves 17, 23, 25, and 51 are triggered by an electric control unit, not shown in detail, which also processes operating parameters at the engine to be supplied.

The fuel injection system according to the invention functions as follows:

The high-pressure fuel pump 1 pumps the fuel out of the low-pressure chamber 5 into the pressure reservoir chamber 9 and thus builds up a high fuel pressure in the reservoir that is controllable via the pressure valves 17 and 25; this pressure control in the pressure reservoir chamber 9 can also be done via an adjustable high-pressure feed pump. The pressure in the pressure reservoir chamber is kept at a maximum first pressure level of approximately 1500 bar, and the storage volume of the pressure reservoir is selected to be so great that the pressure virtually does not drop during an injection period. Once again, connecting a deflection piston or a diaphragm reservoir is also possible, to achieve additional smoothing.

Via the connecting line 11, the fuel, which is at high pressure, when the connecting valve 25 is open flows out of the pressure reservoir chamber 9 into the pressure chamber 13, in which, controlled by the connecting valve 25, a second pressure level can thereby be established that via the injection lines 15 is equivalent to the desired instantaneous injection pressure upstream of the injection valves 21. (This injection pressure in the pressure chamber 13 is controllable via the duration of opening of the connecting valve 25.)

Controlling of the injection event is done in a known manner by the opening and closing motion of the magnet valve 23 in the injection lines 15; the connecting valve 25 is closed during the injection phase at an injection pressure below the first pressure level in the pressure reservoir chamber 9. In the filling phase during the intervals between injection, the reservoir pistons 35, prestressed by the fuel pressure, take on the work of injection and with their reciprocating motion compensate for the volume of the pressure chamber 13 reduced by the injected fuel quantity and thus keep the pressure in the pressure chamber 13 virtually constant.

The instant of opening and the duration of opening of the connecting valve 25 are selected such that between the injection events, the pressure in the pressure chamber 13 is brought back to the desired pressure level. In steady-state engine operation, the injected quantity of fuel must accordingly flow back from the pressure reservoir chamber 9 into the pressure chamber 13 each time between the injections, via the connecting valve 25. If the injection pressure in the pressure chamber 13 should drop, then this returning quantity of fuel must be reduced, and vice versa.

Shaping of the course of injection can be attained if the instant of opening of the connecting valve 25 is selected such that the pressure reservoir chamber 9 communicates with the pressure chamber 13 toward the end of an injection. By this control variant, the injection pressure is raised toward the end of injection to the high pressure level of the pressure reservoir chamber 9. If injection is to be done at maximum system pressure, then the connecting valve 25 remains open; in this operating state, the reservoir piston 35 is held in contact with the second stop 45 by the high fuel pressure, counter to the force of the restoring spring 39, and with its face end keeps the oil leakage bore 47 closed, so that upon injection at the maximum pressure of the pressure reservoir chamber 9, no removal of leaking oil from the sleeve or housing 29 ensues.

In order to enable performing the pressure variation described as fast as possible in the pressure chamber 13, the pressure chamber is dimensioned as so small that not only can the pressure level be kept constant during an injection with reinforcement by the reservoir piston 35, but a rapid pressure decrease in the pressure chamber 13 is also possible, or the injection pressure can be raised during the injection event.

The control of the connecting valve 25 is effected via the electric control unit as a function of the pressure in the pressure reservoir chamber 9, the desired pressure in the pressure chamber 13, the injection quantity, and the temperature.

Operating with two pressure levels in accordance with the invention accordingly makes it possible to choose the injection pressure independently of rpm and variably freely; because of the small volume of the pressure chamber 13 and the injection lines 15 communicating with it (common rail), fast pressure variation times are possible.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection arrangement for internal combustion engines, having a high-pressure fuel pump (1), which communicates with a fuel-filled low-pressure chamber (5) via a fuel supply line (3) and with a pressure reservoir chamber (9) via a high-pressure fuel line (7), said pressure reservoir chamber (9) in turn communicates via separate injection lines (15) with various separate injection valves (21) that protrude into the combustion chamber of the engine to be supplied, the opening and closing motion of each of said injection valves is controlled by a first electrically triggered valve (23) in each of the injection lines (15), the injection lines (15) communicate with the pressure reservoir chamber (9) via a common connecting line (11) and a common pressure chamber (13) said connecting line (11) is openable by means of a second connecting valve (25), wherein said common pressure chamber (13) from which the injection lines (15) lead away, is formed by a portion of the connecting line (11) between the connecting valve (25) and the injection lines (15).

2. A fuel injection arrangement as defined by claim 1, in which the pressure chamber (13) communicates with at least one reservoir device (27) that is prestressed by the high fuel pressure in the pressure chamber (13) and keeps the pressure in the pressure chamber (13), during fuel injection via the injection valve (21), at a constant level by supplying a quantity of fuel corresponding to the injected fuel quantity from the reservoir volume into the pressure chamber (13).

3. A fuel injection arrangement as defined by claim 2, in which the reservoir device (27) is formed by at least one reservoir piston (35) guided in a cylinder liner (31), which piston, with one face end, defines a work chamber (36) that communicates with the pressure chamber (13), and whose second face end remote from the work chamber (36), having an enlarged diameter, is acted upon by a restoring spring (39) fastened in a housing (29) of the at least one pressure reservoir device (27).

4. A fuel injection arrangement as defined by claim 3, in which a reciprocating motion of the reservoir piston (35) is limited in a direction of an enlargement of the work chamber (36) by a stop (45) structurally connected to the housing, and when the reservoir piston (35) is in contact with the stop (45), an oil leakage line (47) leading away from the stop (45) in the pressure reservoir housing is closed by the enlarged end of the reservoir piston (35), which end forms a ram (37).

5. A fuel injection arrangement as defined by claim 1, in which a volume of the common pressure chamber (13) is designed such that not only can a pressure level in the pressure chamber (13) be kept constant during an injection at an injection valve (21) with reinforcement from the storage device (27), but a rapid pressure decrease in the pressure chamber (13) is also possible.

6. A fuel injection arrangement as defined by claim 2, in which a volume of the common pressure chamber (13) is designed such that not only can a pressure level in the pressure chamber (13) be kept constant during an injection at an injection valve (21) with reinforcement from the storage device (27), but a rapid pressure decrease in the pressure chamber (13) is also possible.

7. A fuel injection arrangement as defined by claim 1, in which a first relief line (19) leads away from the pressure reservoir chamber (9) to the low-pressure chamber (5) and includes a third pressure valve (17), by way of which the pressure in the pressure reservoir chamber (9) is adjustable.

8. A fuel injection arrangement as defined by claim 7, in which a second relief line (50) leads away from the pressure chamber (13) and discharges into the first relief line (19) to the low-pressure chamber (5), the second relief line being openable and closeable by means of a fourth valve (51) that is preferably embodied as a 2/2-way magnet valve.

9. A fuel injection arrangement as defined by claim 1, in which the second connecting valve (25) and the first electrically triggered valve (23) in the injection lines (15) are embodied as magnet valves.

10. A fuel injection arrangement as defined by claim 9, in which the injection valves (21) can be made to communicate by means of the first magnet valve (23) with third return lines (49), by way of which a pressure-relieving connection between the injection valves (21) and the low-pressure chamber (5) can be opened.

11. A fuel injection arrangement as defined by claim 8, in which the first, second and fourth magnet valves (23, 25, 51) are triggered by an electronic control unit that as its input variables processes an operating parameter of the engine to be supplied as well as the pressure in the pressure reservoir chamber (9) and in the common pressure chamber (13) and the injection quantities.

12. A fuel injection arrangement as defined by claim 9, in which the first, second and fourth magnet valves (23, 25, 51) are triggered by an electronic control unit that as its input variables processes an operating parameter of the engine to be supplied as well as the pressure in the pressure reservoir chamber (9) and in the common pressure chamber (13) and the injection quantities.

* * * * *